US005745367A

United States Patent [19]

Cha

[11] Patent Number: 5,745,367

[45] Date of Patent: Apr. 28, 1998

[54] FLY BACK TRANSFORMER, AND ITS INDUCTANCE ADJUSTING METHOD AND DEVICE

[75] Inventor: Sang Yeob Cha, Seoul, Rep. of Korea

[73] Assignee: Samsung Electro-Mechanics Co., Ltd., Kyongki-do, Rep. of Korea

[21] Appl. No.: 655,020

[22] Filed: May 29, 1996

[30] Foreign Application Priority Data

May 29, 1995 [KR] Rep. of Korea ..... 1995-13702
May 27, 1996 [KR] Rep. of Korea ..... 1996-17961

[51] Int. Cl.[6] ..... H01F 38/20

[52] U.S. Cl. ..... 364/482; 336/178

[58] Field of Search ..... 364/482; 336/178, 336/134, 219; 324/76.75, 151 R

[56] References Cited

U.S. PATENT DOCUMENTS 4,224,500 9/1980 Cruickshank et al. ..... 219/121.65
4,305,056 12/1981 Mochida et al. ..... 336/178
4,434,547 3/1984 Pascal et al. ..... 29/599

FOREIGN PATENT DOCUMENTS 61-225812 10/1989 Japan .

*Primary Examiner*—James P. Trammell
*Assistant Examiner*—Thomas Peeso
*Attorney, Agent, or Firm*—Lowe, Price, LeBlanc & Becker

[57] ABSTRACT

An FBT, its inductance adjusting method and a device capable of adjusting a gap between the top and bottom cores features a stable inductance value required for the FBT even without requiring a separate spacer between the top and bottom ferrite cores. An adhesive agent is applied to top end of a coupling portion of the bottom core provided within the low voltage bobbin, and a predetermined inductance value between the bottom core and the top core is obtained by a hardening of the adhesive agent therebetween without having a separate gap maintaining arrangement. The inductance value within the FBT can be precisely adjusted even without requiring a separate spacer at the gap portion between the top and bottom ferrite cores of FBT. In addition, it is not necessary to use a U-clip for fixing the top and bottom ferrite cores.

14 Claims, 8 Drawing Sheets

FLY BACK TRANSFORMER, AND ITS INDUCTANCE ADJUSTING METHOD AND DEVICE

BACKGROUND OF THE INVENTION

The present invention generally relates to a fly back transformer (hereinafter called as FBT) capable of adjusting a gap of top and bottom ferrite cores so as to change an inductance value required for the FBT. The present invention relates more specifically to an FBT capable of adjusting its inductance value even without requiring separate spacer between the top and bottom ferrite cores to be provided within the FBT.

An FBT is a high voltage generating device that supplies a high voltage to a cathode-ray tube of television or monitor, so that a FBT having a structure in which a manufacturing process is reduced and productivity is improved using an improved device and method of the present invention. An inductance adjusting method and device is made such that the FBT coupled with a bottom ferrite core is moved to a predetermined position and held as it is, a top ferrite core is fed and this is clamped on top side of bottom ferrite core of the FBT, and the clamped top core is dropped while maintaining a predetermined gap. The inductance value is adjusted within an extent of tolerance, and the FBT is moved together with the top ferrite core which is clamped and adjusted with the inductance value and then hardened by an adhesive agent so as to maintain the inductance value of FBT. Accordingly, the gap can be maintained so as to have always a desired inductance value even without requiring to provide a separate spacer at a gap portion between the top and bottom ferrite cores of FBT.

In a ferrite core inductance adjusting method of a conventional FBT generally known, as shown in FIG. 1, each end of the ferrite cores 302,302' divided to a top portion and a bottom portion are inserted into a core coupling hole 303 of a low voltage bobbin 301. A predetermined gap is distanced between the top and bottom ferrite cores 302, 302' by interposing a separate gap paper 304, and an adhesive agent is applied to the gap paper 304. The top and bottom ferrite cores 302, 302' are coupled and fixed by a U-clip 305.

In accordance with such an inductance adjusting method of the ferrite core of the FBT, the FBT ferrite core is made such that, in a case when the ferrite cores 302, 302' are coupled and fixed integral with a low voltage bobbin 301 provided within interior of FBT, the bottom ferrite core 302' is laid on a palette, and a separate gap paper 304 having a minute thickness is put on and applied with an adhesive agent to the bottom ferrite core. The top ferrite core 302 is laid thereon again before the adhesive agent would be hardened, one side of the top and bottom ferrite cores are coupled by a U-clip 305 whereby the ferrite cores are fixed, so that a gap is maintained so as to have a predetermined inductance value of the FBT.

For the FBT, in case of a television set, the inductance value is set to usually about 1.3 mmH+−7%. Since a forming clearance of the gap for said value is extremely small range of about 0.35 mm, it exceeds the tolerance of the inductance setting value even if the gap is mistaken only by 5/100 mm according to external condition as above, and therefore the gap should be adjusted by a very precise condition.

However, in accordance with the inductance maintaining method between the top and bottom ferrite cores 302, 302' as above, since a number of working processes are required whereby workability is decreased and it is done to maintain the inductance value only by considering a clearance of gap, there has been problems that there were cases where horizontal and vertical deviations between the gap occurred or a center of the gap paper was not accorded therewith. In addition, a condition such as a flat state of coupling portion of the core to be coupled with the gap paper as well as a gap of uniform condition in working process for making the gap became difficult to attain. Accordingly, the gap between coupling portions of the top and bottom ferrite cores 302, 302' became uneven whereby they became to have different inductance values from each other, and therefore badness or poor performance frequently occurred.

On the other hand, recently a method is known which stabilizes an inductance value of precise state by uniformly maintaining a gap of the FBT ferrite core through an inductance adjusting device.

That is, in accordance with Japanese laid open patent publication Sho-60-225812, as shown in FIG. 2, a gap 402 is formed between top and bottom ferrite cores 401, 401' to be provided to FBT 300, and a spacer 403 is provided between said gap 402, so that an inductance value of the ferrite core is obtained by a press 405 connected with a rod 404.

In case of above description, a spacer 403 is interposed to a gap 402 portion between the top and bottom ferrite cores 401, 401' of the FBT 400 and the top and bottom ferrite cores are pressed, so that the resilient spacer 403 is pressed whereby the inductance value of FBT is obtained as in FIG. 3.

However, it is difficult to obtain an inductance value of precise state according to various conditions as above, except using a structure which provides a separate resilient spacer instead of a gap paper as above to the gap portion between the top and bottom ferrite cores.

OBJECT AND SUMMARY OF THE INVENTION

Therefore, the present invention is invented to solve and improve such conventional problems as described above, and it is an object of the present invention to provide a FBT capable of maintaining a gap so as to have always a desired inductance value without requiring to provide a separate spacer to the gap portion between the top and bottom ferrite cores of the FBT.

Another object of the present invention is to provide an inductance value adjusting method and device of FBT in which a gap of top and bottom ferrite cores is automatically maintained and fixed by coupling in a firm condition through an inductance adjusting device, whereby a use of U-clip for fixing the top and bottom ferrite cores is not required. The inductance adjusting operation of the FBT can be obtained to an easy and precise state by a simple method, so that a quality of FBT is standardized due to maintaining of the gap so as to have a desired inductance value of the ferrite core, and a badness occurrence or fluctuation of the inductance value can be prevented.

As a technical means for obtaining above objects, the present invention provides an inductance adjusting method of FBT comprising:

- a step in which a palette to be fixed with FBT is completed to be conveyed to a designated assembling position through a conveyor and then presence or absence of the palette is detected by a position detecting means,
- a step in which a driving means and a chucking device provided to a clamping unit are integrally descended by an ascending and descending means and a detector contacts with a terminal pin protruded at top side of low voltage bobbin of FBT whereby the top core is descended up to a setting position, a step in which a conveying means for conveying the top and bottom cores to up and down is clamped by a chucking device, a driving means is driven by a signal of a driving control means whereby the conveying means to be clamped to a chuck of the chucking device is rotationally driven and simultaneously the top core is descended and conveyed up to a standard position, a step for repeating a process which compares whether or not an inductance value according to a measured signal inputted from an LCR measuring means is set within a tolerance of a standard value, and when it is not present within said tolerance value, the driving means is driven by a signal of the driving control means and thereby a conveying means clamped by a chuck of the chucking device is finely rotated, and a step, when said inductance value is set within the tolerance value, which releases off the clamping pin of the conveying means conveying the top core to up and down, ascends the clamping unit provided with the driving means integral with the chucking device, and that a palette positioned with said FBT is discharged for hardening of an adhesive agent by the conveyor.

And, the present invention provides an inductance adjusting device of FBT comprising:

a microprocessor for controlling to execute the process, a position detecting means for detecting a presence or absence of a designated position of a palette conveyed by a conveyor, a clamping unit driving means for receiving a control signal from the microprocessor and integrally ascending and descending the clamping unit provided with a driving means and a chucking device by an ascending and descending means, a chucking device for clamping a conveying means conveying the top core up and down and for descending the top core by a driving of the driving means, LCR measuring means for measuring an inductance of a gap between the top and bottom cores of the FBT and outputting to said microprocessor, a driving control means for receiving a control signal from the microprocessor and driving and controlling the driving means, and a driving means for receiving a driving signal from the driving control means and rotationally driving integrally with the conveying means and for executing an adjusting operation of the inductance value.

And, the present invention provides a FBT in which an adhesive agent is applied to top end of the coupling portion of a bottom core provided within the low voltage bobbin of the FBT. A gap between the top and bottom cores is maintained so as to have a predetermined inductance by a hardening of the adhesive agent without having a separate gap maintaining means between the bottom core and the top core.

DETAILED DESCRIPTION OF THE INVENTION

Hereinafter, the present invention will be described more in detail with reference to the accompanying drawing.

Figure 1:
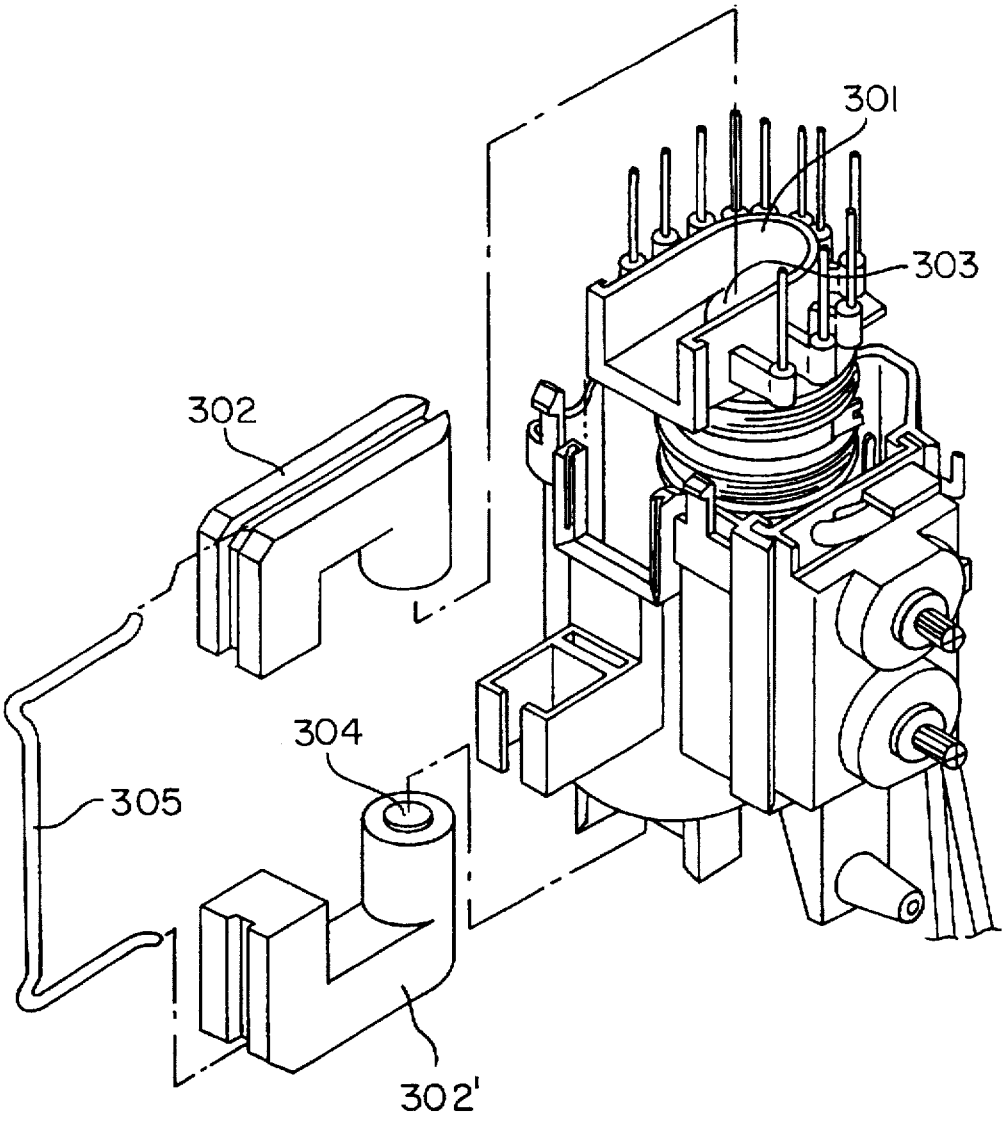
FIG. 1 PRIOR ART
FIG. 1 is an exploded perspective view of the FBT showing a general ferrite core coupling structure.
Figure 2:
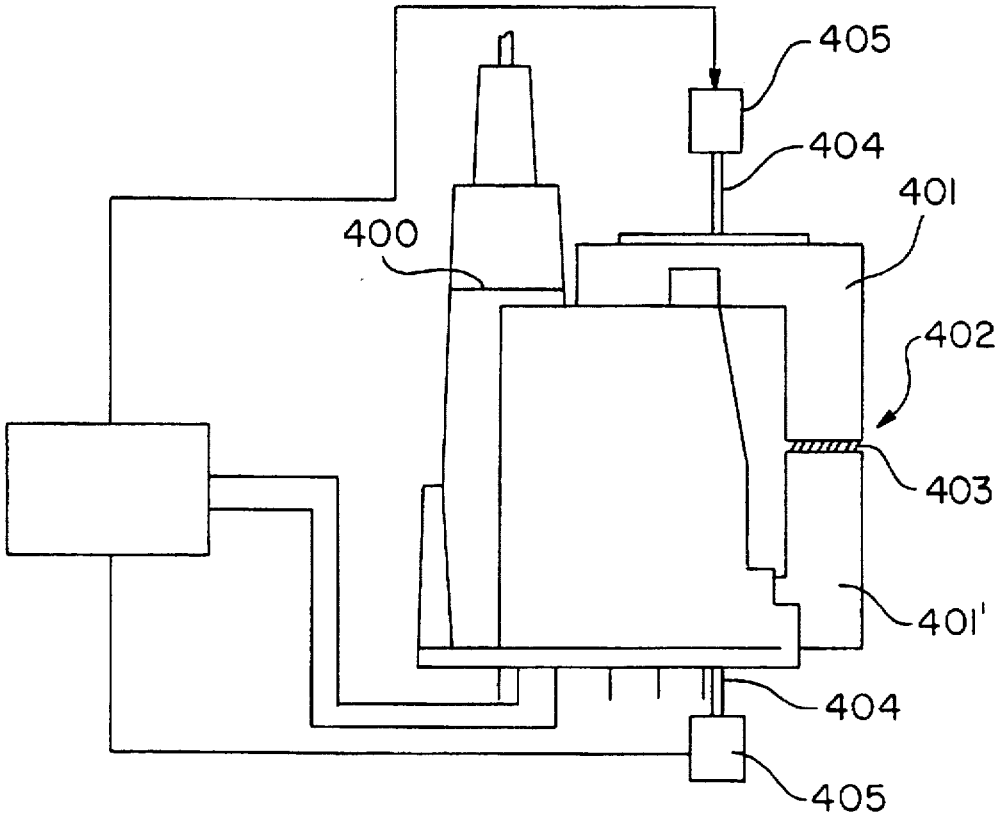
FIG. 2 PRIOR ART
FIG. 2 is a view for explaining a conventional FBT ferrite core coupling method.
Figure 3:
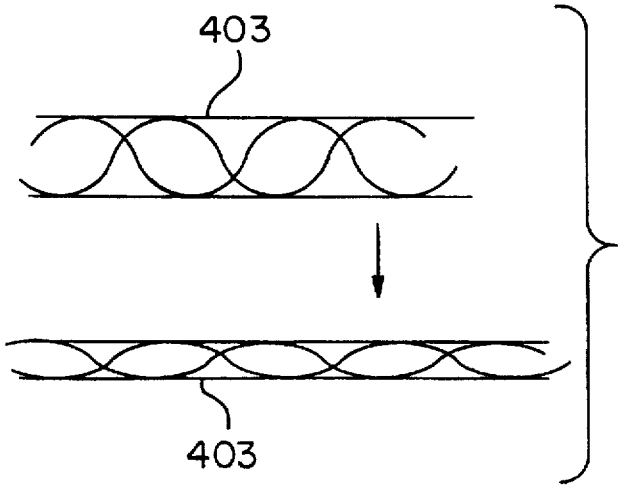
FIG. 3 is a view showing a modified state of a spacer provided between the ferrite cores of FIG. 2.
Figure 4:
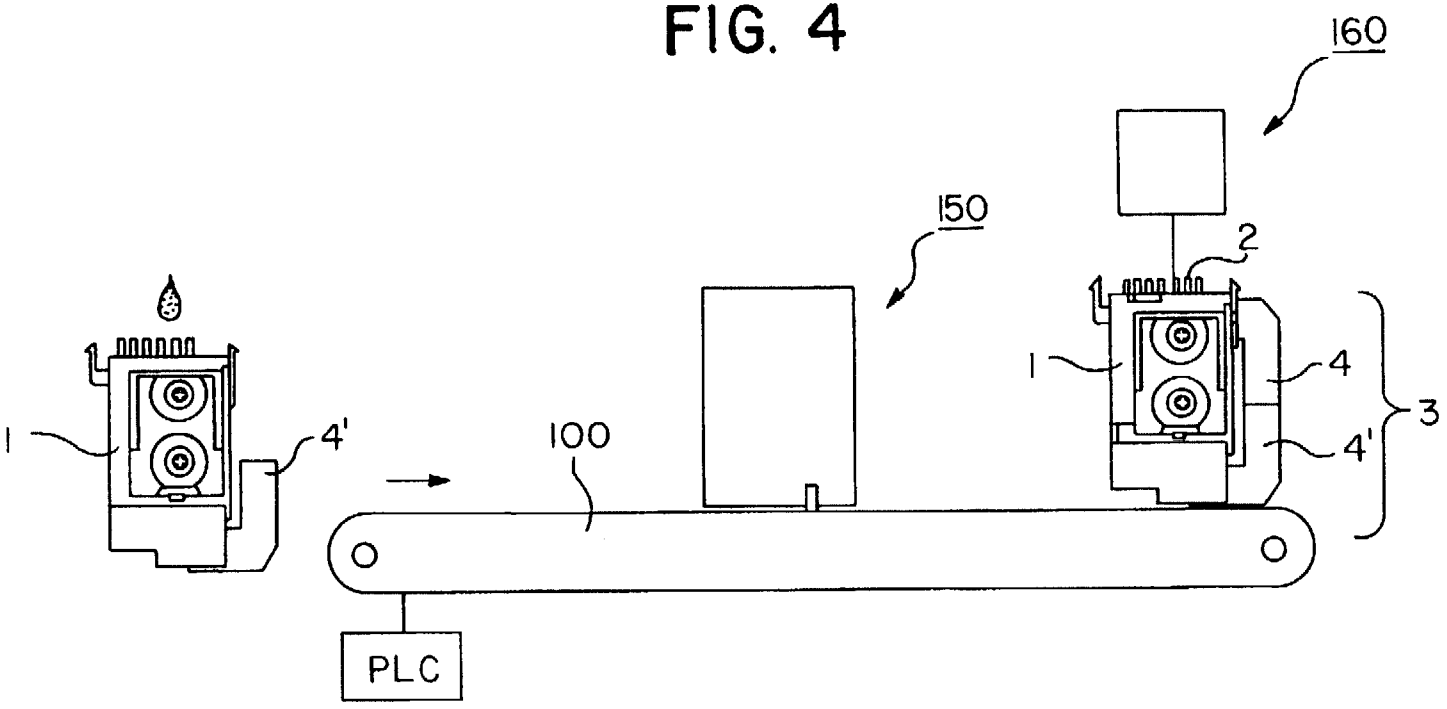
FIG. 4 is a schematic structural view showing an inductance adjusting and discharging process of the FBT in accordance with the present invention.

A schematic structural view showing an inductance adjusting and discharging of FBT in accordance with the present invention is shown in FIG. 4.

That is, a FBT is provided respectively with a high voltage and low voltage bobbins 2 wound with coils for outputting a high voltage within a case of FBT 1, and a focus unit for outputting of focus and screen voltage is provided at one side of the case of the FBT and connected through the bobbin and a cable.

And, a high voltage outputting means is provided at one side at the top of the FBT case and an anode cable is connected thereto. The anode cable is provided to output a high voltage to a cathode-ray tube, and a ferrite core 3, inserted and passed through a center of the low voltage bobbin 2 and disposed to one side exterior of the FBT case, is assembled to said FBT 1.

The FBT 1, completed to assemble as above, is filled with an insulation resin for an insulation of its interior, and fixed on a palette 110 and conveyed by a conveyor and passed through an inductance adjusting means 150 of the FBT. An inductance value produced from the FBT 1 is adjusted without requiring a separate gap maintaining means between the ferrite cores 3 constructed by and divided to top and bottom cores 4, 4', and the adjusted and completed FBT 1 is discharged and passed through a hardening process of an adhesive agent to maintain a predetermined inductance value.

Figure 5:
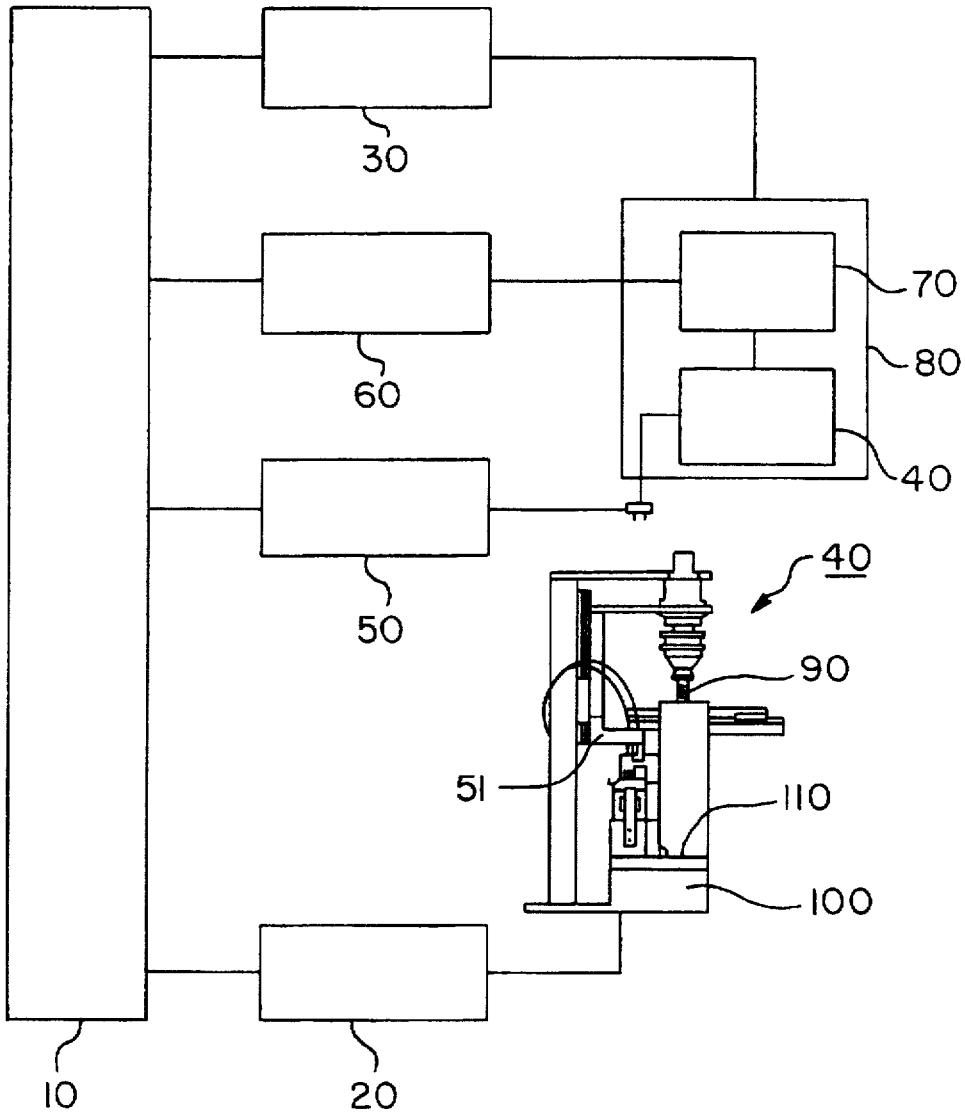
FIG. 5 is a block diagram showing a structure of the FBT inductance adjusting device in accordance with the present invention.
Figure 6:
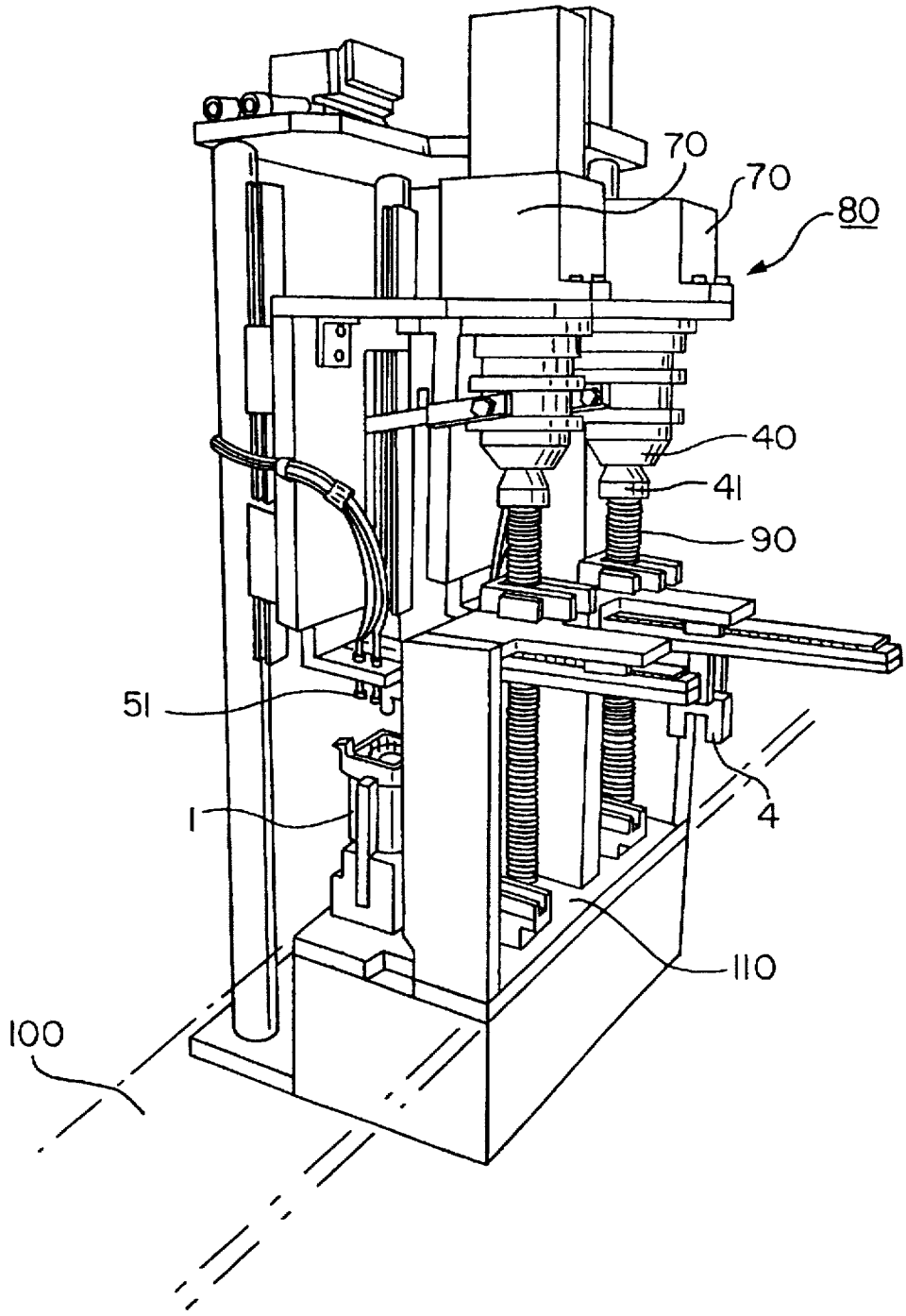
FIG. 6 is a view showing an inductance adjusting device of the present invention.

A block diagram showing a structure of the FBT inductance adjusting means in accordance with the present invention is shown in FIG. 5, and the above described inductance adjusting device is shown in FIG. 6.

The inductance adjusting device of the FBT as above is provided with a microprocessor 10 for controlling each means or device by receiving or storing a program for controlling to execute a process according to the present invention from a large memory means (not shown). The inductance adjusting device also includes a position detecting means 20 for detecting a presence or absence of a designated position of palette 10 conveyed by a conveyor, and a clamping unit driving means 30 for receiving a control signal from the microprocessor 10 and integrally ascending or descending a clamping unit 80 provided with a driving means 70 and a chucking device 40 by a standard ascending and descending means (not shown and described in detail below).

The inductance adjusting device also comprises a chucking device 40 for descending a top core by a driving of the driving means and by clamping a conveying means 90 conveying the top core to up and down. A LCR measuring means 50 is also provided for measuring an inductance of gap portion between the top and bottom cores of the FBT 1 and for outputting to the microprocessor 10 together with a driving control means 60 for receiving a control signal from the microprocessor 10 and driving and controlling a driving means 70. The driving means 70 receives a driving control signal from the driving control means 60, and executes an adjusting operation of the inductance value by being rotationally driven integrally with the conveying means 90.

The clamping unit 80 is provided with the driving means 70 to bias it upward, and the chucking device 40 is connected thereto so as to be rotationally driven. A chuck 41 provided to the chucking device 40 is made to integrally ascend and descend with the clamping unit 80 by the ascending and descending means and provided so as to clamp the conveying means 90.

Driving means 70, driven by the driving control means 60, is constructed by a servo motor, and a sensor 51 which is connected to the clamping unit 80. Driving means 70 is provided to integrally ascend and descend sensors and transfers an inductance value to LCR measuring means 50 by contacting with a terminal pin of a low voltage bobbin.

The conveyor 100, for conveying the FBT 1, is provided with the core conveying means 90 integrally with the FBT at top thereof on the palette 110.

The FBT inductance adjusting method in accordance with the present invention will be described below.

Figure 8:
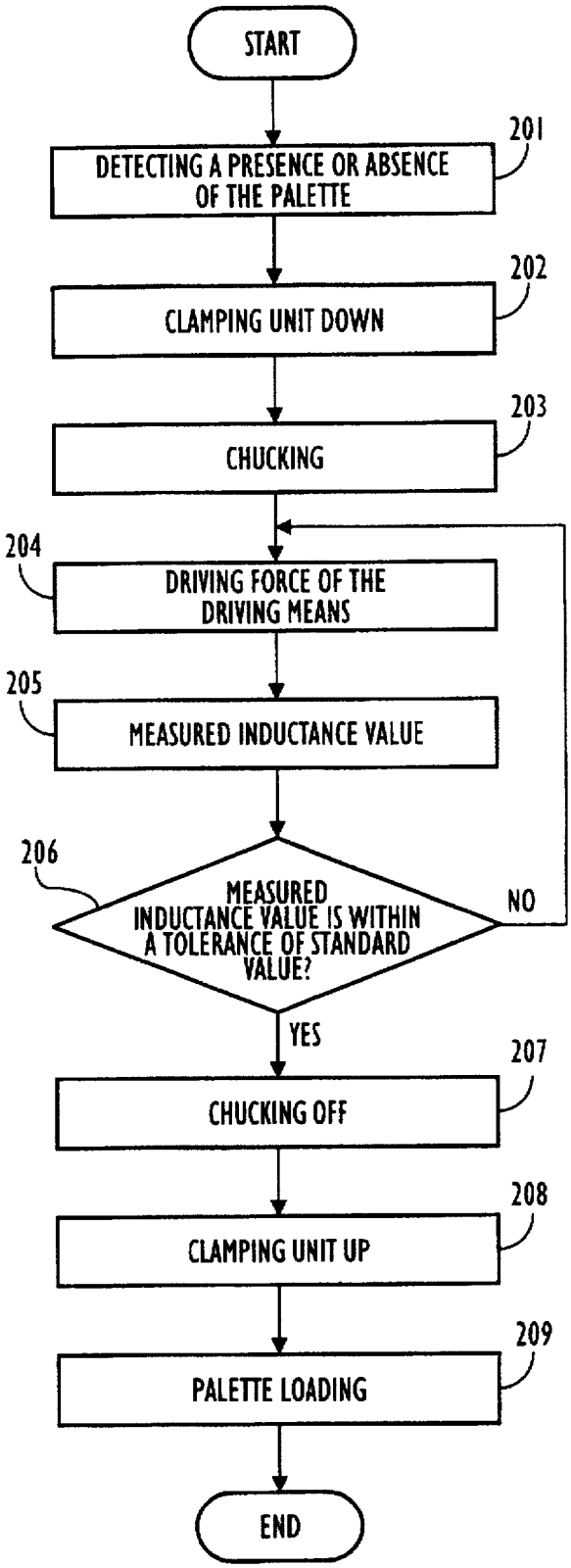
FIG. 8 is a flow chart illustrating an inductance adjusting method in accordance with the present invention.

FIG. 8 shows a flow chart illustrating an inductance adjusting method of the FBT in accordance with the present invention.

The FBT 1, completed to assemble the low and high voltage bobbins within its interior, is filled by an insulation resin for an insulation of its interior, and then fixed on the palette 110. The FBT is conveyed by a conveyor 100 and advanced to an inductance adjusting means 150 of the FBT. Thereafter, the conveying operation is stopped by a stopper (not shown) to execute an inductance adjusting operating of the following steps.

At step 201, the palette 110 is conveyed to the top core assembling position, a designated position of the inductance adjusting means 150. A presence or absence of the palette is detected using a sensor and a detecting means 20, and a signal is transferred to the microprocessor 10 regarding its presence or absence.

After the palette 110 with FBT 1 is completed to be conveyed to an assembling position being a designated position at step 202, the driving means 70 and the chucking device 40, provided to the clamping unit 80, receive a control signal from the microprocessor 10, and descend integrally with the clamping unit 80 by an ascending and descending means. The sensor 51, provided at one side of the clamping unit 80, becomes in contact with a terminal pin protruded at a top side of the low voltage bobbin of FBT 1.

A means for ascending and descending the clamping unit 80 by a control signal of the microprocessor 10 can be executed by cylinders operated by, for example, oil pressure or pneumatic pressure, and the sensor 51, ascended and descended by being connected with the clamping unit 80, becomes in contact with the terminal pin of the low voltage bobbin 2 by utilizing, e.g., a probe.

At step 203, the conveying means 90, conveying the top core 4 up and down, is clamped by a chuck of the chucking device 40. At step 204, a control signal of the microprocessor 10 is received and the driving means 70 is driven by the signal of the driving control means 60. The conveying means 90 is clamped to the chuck 41 of the chucking device 40 by a rotational driving of the driving means 70, and thereby the top core 4 is descended and conveyed up to a set distance.

Figure 7:
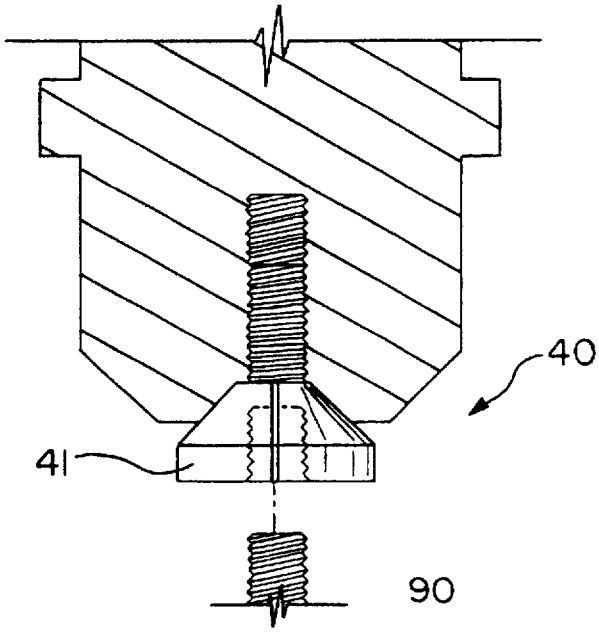
FIG. 7 is a view showing an example of a chucking device of the present invention.

The chuck 41 of the chucking device 40, as shown at an example in FIG. 7, is provided with a number of jaws at the bottom side of the main body when a ball screw, being a conveying means 90 conveying the top and bottom cores to up and down positions, is clamped, and the top core fixed to the conveying means 130 is descended and conveyed up to a set position by a driving force of the driving means 70.

The driving means 70, driven by the driving control means 60, can be accomplished by a servo motor, and it can be realized by other driving means as well.

At step 205, the top core, that has completed the descending conveyance to a designated position by a driving of the driving means, is distanced by a predetermined gap from the bottom core assembled to the FBT, and an inductance value is measured by the LCR measuring means 50. At step 206, it is judged or determined whether or not the inductance value, by a measuring signal inputted to LCR measuring means 50 through the sensor 51, is set within a tolerance of a standard or reference value.

In cases when the thus measured inductance value is not present within an allowable range of a reference value, the steps below or before the step 204 are repeatedly executed. In cases when the inductance value measured by a fine driving of the driving means 70 is present within an allowable range of the reference value, the process advances to a step 207.

At step 207 and 208, the chuck of the chucking device 40 releases a clamping of the conveying means 90 conveying the top core 4 to up and down positions. The clamping unit 80, provided with the driving means 70 integral with the chucking device 40, is driven to ascend by a control signal of the microprocessor 10.

At step 209, a stopper is removed by a control signal of a PLC control means controlling the conveyor 100, and the top core maintains a predetermined gap with the bottom core of the FBT. The palette 110, positioned with FBT 1 of assembled state, is discharged and conveyed whereby an adjustment of the inductance is completed.

On the other hand, the FBT 1 completed the inductance adjusting operation, as shown in FIG. 4, is conveyed by the conveyor 100 and the top and bottom cores are firmly coupled by a hardening of adhesive agent. Then, only a FBT assembled and completed with top and bottom cores is separated by a separator 160 so as to be conveyed to the next process.

Figure 9:
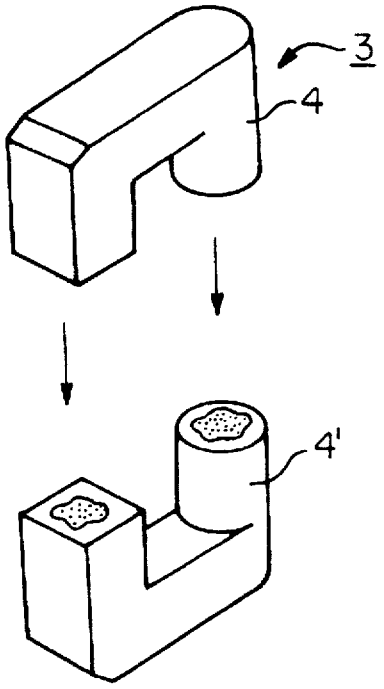
FIG. 9 is a view showing a coupling state of ferrite cores of the FBT of the present invention.

The FBT 1 assembled as above, as shown in FIG. 9, passes through the steps as described above at a state that the adhesive agent is applied to top end of the coupling portion of the bottom core 4' provided within the interior of the low voltage bobbin 2 of the FBT 1. The adhesive agent is thus provided between the bottom core 4' and the top core 4 resulting in the maintenance of a predetermined gap. Therefore, a mutually distanced gap within an inductance value tolerance can be produced by a hardening of an adhesive agent without other separate gap maintaining means.

In accordance with the ferrite core inductance adjusting method of the FBT according to the present invention described above, the inductance value within the FBT can be precisely adjusted even without requiring a separate spacer at a gap portion between the top and bottom ferrite cores of the FBT. Not only can the gap be maintained so as to have a stable desired inductance value, but also the gap between the top and bottom ferrite cores is automatically coupled and fixed in a firm state. Thus, it is not necessary to use a U-clip for fixing the top and bottom ferrite cores. Therefore, there is the effect that a quality of the FBT is standardized due to the maintaining of a predetermined inductance value for the ferrite core, and a badness generation or fluctuation of the inductance value can be prevented.

The present invention is shown and described with regard to a particular embodiment, however it is clear to easily know for those who, having ordinary knowledge in this art, that the present invention can be variously modified and changed without getting out of the spirit or field of the invention provided by following claims.

What is claimed is:

1. An inductance adjusting method of a FBT having top and bottom cores, comprising:

a step in which a palette to be fixed with the FBT is conveyed to a designated assembling position through a conveyor and then a presence or absence of the palette is detected by a position detecting means, a step in which a driving means and a chucking device provided to a clamping unit are integrally driven by an ascending and descending means and a detector contacts with a terminal pin protruded at a top side of a low voltage bobbin of the FBT whereby the top core is driven to a setting position, a step in which a conveying means for conveying the top and bottom cores upwardly and downwardly is clamped by a chucking device, the driving means is driven by a signal of a driving control means whereby a clamping pin of the conveying means to be clamped to a chuck of the chucking device is rotationally driven and simultaneously the top core is conveyed to a reference position, a step for repeating a process which compares whether or not an inductance value according to a measured signal inputted from an LCR measuring means is set within a tolerance value, and when the inductance value is within the tolerance value, drives the driving means by the signal of the driving control means and thereby finely rotating the clamping pin of the conveying means to be clamped to the chuck of the chucking device, and a step, when said inductance value is set within the tolerance value, releasing the clamping pin of the conveying means, and driving the clamping unit provided with the driving means integral with the chucking device to discharge the palette placed with said FBT for a hardening of an adhesive agent introduced by the conveyor between the top and bottom cores.

2. An inductance adjusting method of a FBT as defined in claim 1, wherein said driving means for driving the clamping unit comprises a servo motor.

3. An inductance adjusting device of a FBT having top and bottom cores, comprising:

a microprocessor for controlling execution of a process and outputting a control signal, a conveyor conveying the FBT to a designated position, a position detecting means for detecting a presence or absence of the FBT at the designated position of a palette conveyed by the conveyor, a clamping unit driving means for receiving a control signal from the microprocessor and integrally ascending and descending a clamping unit provided with a driving means and a chucking device using an ascending and descending means, the chucking device for clamping a conveying means conveying the top core upwardly and downwardly and descending the top core responsive to the driving means, LCR measuring means for measuring an inductance value of a gap between the top and bottom cores of the FBT and outputting the inductance value to said microprocessor, a driving control means for receiving the control signal from the microprocessor and generating a driving signal for controlling the chucking device and the conveying means, and the driving means for receiving the driving signal from the driving control means and rotationally driving integrally with the conveying means and executing an adjusting operation of the inductance value including applying an adhesive agent between the top and bottom cores of the FBT thereby securing a map between the top and bottom cores and maintaining the inductance value within a tolerance of a predetermined inductance.

4. An inductance adjusting device of a FBT as defined in claim 3, wherein said clamping unit is provided with the driving means, and the chucking device is connected to said driving means so as to be rotationally driven thereby, and a chuck provided to the chucking device is made to ascend and descend integrally with the clamping unit by an ascending and descending means and provided so as to clamp the conveying means.

5. An inductance adjusting device of a FBT as defined in claim 3, further comprising a sensor connected to said clamping unit and provided to integrally ascend and descend therewith, said sensor with a terminal pin of a low voltage bobbin of the FBT and transfer the inductance value to said LCR measuring means.

6. An inductance adjusting device of a FBT as defined in claim 3, wherein the conveyor for conveying the FBT is provided with a core conveying means integrally with the FBT at a top thereof and on the palette.

7. In a FBT having a ferrite core including top and bottom cores which is made such that high voltage and low voltage bobbins wound with coils for outputting a high voltage is provided therein, a focus unit for outputting a focus and screen voltage is provided to one side of the FBT and connected to said high and low voltage bobbins, a high voltage outputting means is provided at one side of the FBT and an anode cable is connected thereto so as to output the high voltage, and the ferrite core is inserted into and passed through a center of the low voltage bobbin, and the ferrite core is structured to be divided to the top and bottom cores so as to maintain a gap for an inductance adjustment of the FBT between the top and bottom cores, the FBT in which an adhesive agent is applied to a top end of a coupling portion of the bottom core provided within an interior of the low voltage bobbin of the FBT, and the gap between the top and bottom cores is made to be maintained between the bottom core and the top core so as to have a predetermined inductance value by a hardening of the adhesive agent without having a separate gap maintaining means.

8. A FBT as defined in claim 7, wherein the gap between the top and bottom cores is established within a tolerance range of the predetermined inductance value of the FBT.

9. In an inductance adjusting device of a fly back transformer (FBT) having top and bottom cores, the inductance adjusting device including a control processor, a position sensor detecting a presence of a palette conveyed by a conveyor, a FBT positioning device positioning the top and bottom cores, and an inductance detector detecting an inductance value of a gap between the top and bottom cores of the FBT, a method comprising the steps of:

applying an adhesive agent between the top and bottom cores of the FBT;

measuring the inductance value of the gap formed between the top and bottom cores;

adjusting the gap between the top and bottom cores so that the inductance value is within a tolerance of a predetermined inductance value prior to hardening of the adhesive agent; and waiting a predetermined period of time until the adhesive agent hardens, securing the gap adjusted by said adjusting step and maintaining the inductance value within the tolerance of the predetermined inductance.

10. In an inductance adjusting device of a fly back transformer (FBT) having top and bottom cores, the inductance adjusting device including a control processor, a position sensor detecting a presence of a palette conveyed by a conveyor, a FBT positioning device positioning the top and bottom cores, and an inductance detector detecting an inductance value of a gap between the top and bottom cores of the FBT, a method comprising the steps of:

applying an adhesive agent between the top and bottom cores of the FBT; and waiting a predetermined period of time until the adhesive agent hardens, securing a gap between the top and bottom cores and maintaining the inductance value within a tolerance of a predetermined inductance.

11. In an inductance adjusting device of a fly back transformer (FBT) having top and bottom cores, a method comprising the steps of:

applying an adhesive agent between the top and bottom cores of the FBT; and waiting a predetermined period of time until the adhesive agent hardens, securing a gap between the top and bottom cores and maintaining the inductance value within a tolerance of a predetermined inductance.

12. An inductance adjusting device of a fly back transformer (FBT) having top and bottom cores, comprising:

means for applying an adhesive agent between the top and bottom cores of the FBT; and means for waiting a predetermined period of time until the adhesive agent hardens, for securing a gap between the top and bottom cores and for maintaining the inductance value within a tolerance of a predetermined inductance.

13. An inductance adjusting device of a fly back transformer (FBT) having top and bottom cores, comprising:

an application device applying an adhesive agent between the top and bottom cores of the FBT; and a securing device securing a gap between the top and bottom cores and maintaining the inductance value within a tolerance of a predetermined inductance responsive to hardening of the adhesive agent.

14. An inductance adjusting device of a fly back transformer (FBT) having top and bottom cores, comprising:

applying an adhesive agent between the top and bottom cores of the FBT; and securing a gap between the top and bottom cores and maintaining the inductance value within a tolerance of a predetermined inductance responsive to hardening of the adhesive agent.

* * * * *